United States Patent [19]

McCaslin

[11] 4,332,385

[45] Jun. 1, 1982

[54] GAME WITH MOVEABLE MAZE ON GAME BOARD

[76] Inventor: Robert E. McCaslin, 1227 Coldwater Canyon, Beverly Hills, Calif. 90210

[21] Appl. No.: 223,518

[22] Filed: Jan. 8, 1981

[51] Int. Cl.[3] ..... A63F 7/24; A63F 7/38

[52] U.S. Cl. ..... 273/113

[58] Field of Search ..... 273/109, 110, 113, 115, 273/116

[56] References Cited

U.S. PATENT DOCUMENTS

| | | | |
|---|---|---|---|
| 286,868 | 10/1883 | Thompson | 273/115 X |
| 425,575 | 4/1890 | Lott | 273/115 |
| 496,202 | 4/1893 | Leighton | 273/109 |
| 4,061,334 | 12/1977 | Kanno | 273/109 X |
| 4,163,558 | 8/1979 | Jaworski et al. | 273/115 |
| 4,248,427 | 2/1981 | Vierimaa | 273/110 |

*Primary Examiner*—Richard C. Pinkham
*Assistant Examiner*—Scott L. Brown
*Attorney, Agent, or Firm*—John L. McGannon

[57] ABSTRACT

Apparatus for playing a game with a moveable player piece, such as a marble or steel ball, and a game board having a start position and a finish position for the player piece. A maze is mounted on the game board for rotation along the upper surface thereof, the maze including walls which present obstacles for the player piece yet the walls have openings therethrough to permit the player piece to pass through the maze as the player piece is maneuvered toward a finish position on the game board as the game board itself is manually manipulated by tilting it up and down and from side to side. The maze is coupled by a shaft to a mechanical or an electric drive motor mounted below the game board surface and the speed of the motor can be changed to vary the speed of rotation of the maze. The game board has two adjacent recesses for receiving the player piece, one defining the winning location and the other defining a losing location. The object of the game is to manipulate the game board as the maze rotates to cause the player piece to enter the winning recess.

10 Claims, 2 Drawing Figures

GAME WITH MOVEABLE MAZE ON GAME BOARD

Figure 1:
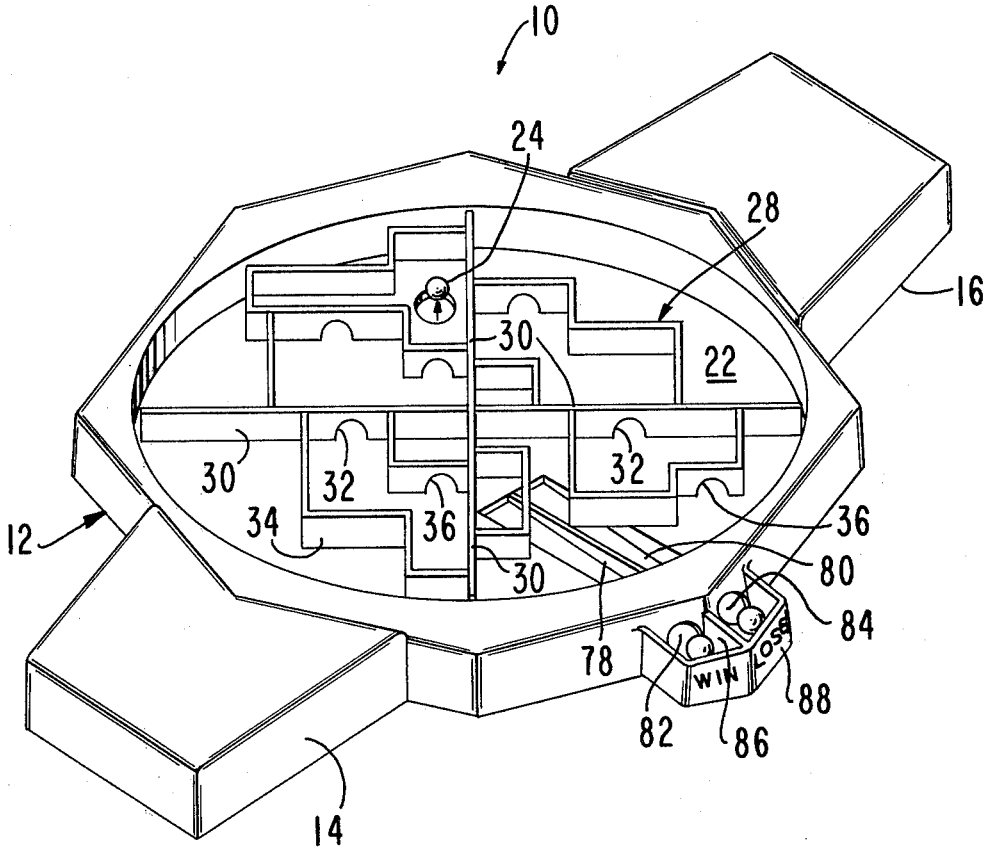

This invention relates to games played by rolling marbles or balls over a game board surface and, more particularly, to a game apparatus which has a hand-held game board and a rotatable maze moveable over the game board for presenting obstacles to a moving player piece over the game board as the player piece is maneuvered toward a finish location.

BACKGROUND OF THE INVENTION

The use of rolling player pieces on a hand-held game board from one location to another has been known in the past. For the most part, games of this type, while manually manipulated by tilting the game board thereof, generally have no obstacles or very few obstacles for the player piece to bypass. The obstacles that are provided are generally fixed in nature and, after a few plays of the game, the obstacles can generally be easily overcome in moving the player piece from a start location to a finish location. Thus, the games of conventional design of the type mentioned above usually present only a minimum challenge and do not stimulate the interests of the players to increase their dexterity in manipulating the game board to win a game of this type. For this reason, conventional games suffer from certain drawbacks and a need has arisen for an improved game of this type in which a greater challenge is provided for a player to improve his or her manual skills as well as to stimulate the interest in playing a game in which greater obstacles must be overcome to win the game.

SUMMARY OF THE INVENTION

The present invention satisfies the aforesaid need by providing a game apparatus in which a game board of having a fixed surface has a start location and a finish location. The locations are spaced apart so that a player piece, such as a marble or steel ball, can be moved over the game board surface by manually manipulating the game board such as by tilting it up and down and from side-to-side.

An important feature of the present invention is the use of structure rotatably mounted on the game board for defining a maze of passages through which the player piece must pass as it moves from the start location to the finish location. The structure is comprised of a number of walls which define obstacles for the player piece, certain of the walls having openings therethrough to permit passage of the player piece through the maze as the maze rotates relative to the game board surface and as the game board itself is manually manipulated.

The means of rotating the maze includes a drive motor beneath the game board itself, the drive motor being either mechanical (spring motor) or electrical and coupled by gears or other means to a shaft connected to the maze. The motor speed may be varied to change the speed of rotation of the maze to make it easier or more difficult to manipulate the player piece toward the finish location during the play of the game.

The game board has a pair of adjacent recesses for receiving the player piece, one of the recesses being defined as the winning recess and the other defined as the losing recess. Thus, even if the player piece can be successfully manipulated to the finish location, it is still necessary for the player piece to be deposited in the proper recess to win the game. This requirement greatly sharpens the skills needed to play the game and adds to the enjoyment and stimulation of the players as they compete with each other.

The primary object of this invention is to provide an improved game apparatus of the type having a player piece, such as a rolling marble or steel ball moveable over a game board surface wherein the apparatus includes a maze of passages with the maze being rotatable over the game board to define obstacles for a player piece as it is moved from a side location to a finish location by the manual manipulation of the game board itself to provide enjoyment of the player of the game yet require the player to exercise normally uncalled-for manual skills to maneuver the player piece the finish location.

Other objects of this invention will become apparent as the following specification progresses, reference being had to the accompanying drawing for an illustration of the invention.

IN THE DRAWINGS

Figure 2:
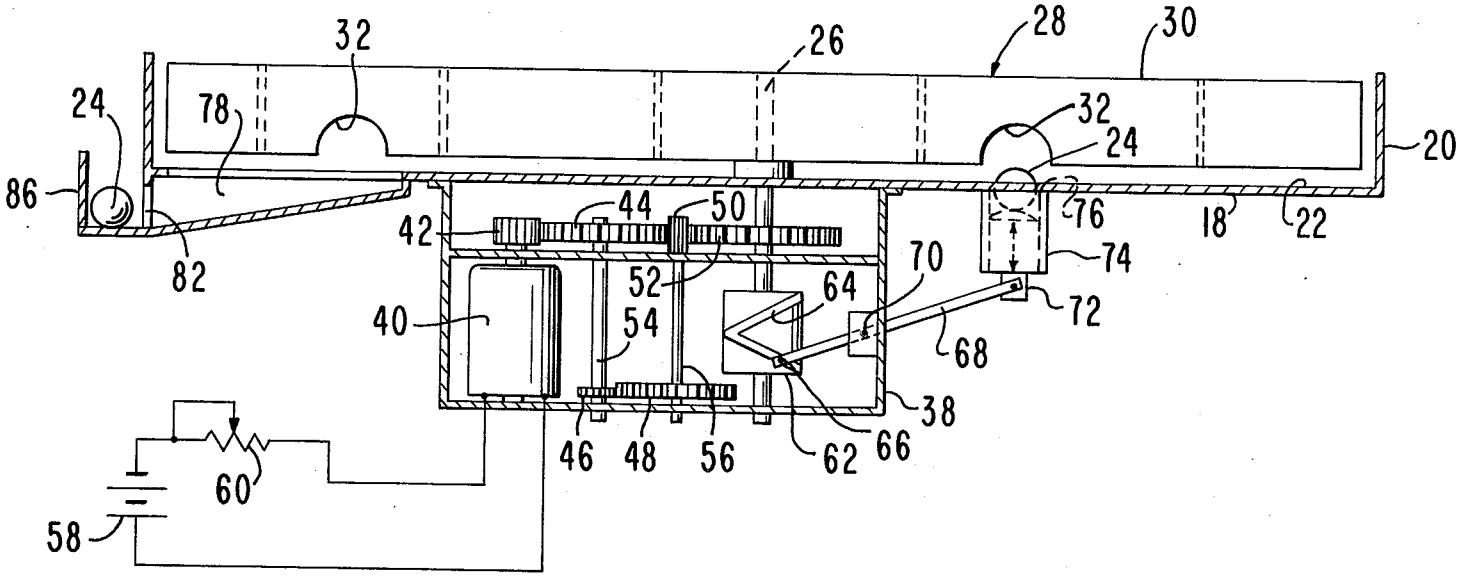

FIG. 1 is a perspective view of a game apparatus of the present invention, showing a game board having a rotatable maze mounted above its upper surface; and FIG. 2 is an enlarged, vertical section, partly schematic, of the game apparatus.

The game apparatus of the present invention is broadly denoted by the numeral 10 and includes a base 12 having a pair of handles 14 and 16 at diametrically opposed sides of the base. The handles are used for manually holding apparatus 10 to manipulate the apparatus by tilting it back and forth and from side-to-side to cause a player piece hereinafter described to move over a game board surface against obstacles placed in the path of the member.

Base 12 has a bottom wall 18 and a generally continuous side wall 20 extending upwardly from bottom wall 18 as shown in FIG. 2. The upper surface 22 of bottom wall 18 provides a surface over which a player piece, such as a marble or steel ball 24, rolls. For purposes of illustration only, the outer periphery of surface 22 is circular but it could be of other shapes, if desired.

A generally vertical shaft 26 is rotatably mounted on bottom wall 18 and extends upwardly therefrom. A rotatable maze 28 is secured to the upper end of shaft 26 for rotation therewith. Maze 28 has four, mutually perpendicular arms or walls 30 as shown in FIG. 1 which radiate from the central axes of shaft 26. Each arm 30 has an opening 32 therethrough through which player piece 24 can pass as maze 28 rotates relative to surface 22. Maze 28 further includes additional walls or partitions 34, some of which have openings 36 therethrough similar in size and shape to openings 32 so that player piece 24 can pass through openings 36 as well as openings 32 as maze 28 rotates relative to surface 22. Thus, maze 28 defines a plurality of passages or paths through which or over which player piece 24 can move during the play of a game with apparatus 10.

Shaft 26 extends downwardly from bottom wall 18 of base 12 as shown in FIG. 2 and extends into a housing 38 secured to the base in any suitable manner. The housing contains a d.c. electric motor 40 which is coupled by gears 42, 44, 46, 48, 50 and 52 to shaft 26. The various gears are required to step down the rotational speed of motor 40 to a desired rotational speed of shaft 26 such as 1 to 7 revolutions per minute. Gears 44 and 46 are interconnected by a shaft 54 and gears 48 and 50 are interconnected by a shaft 56. Shafts 54 and 56 are journalled in housing 38 in any suitable manner and are generally parallel with shaft 26. Motor 40 is coupled to a power source such as a battery 58 through a variable resistor 60 to permit variations in the rotational speed of the motor. Also, motor 40 can be a mechanical motor, such as a spring motor, if desired.

Shaft 26 carries a cam member 62 for rotation therewith. The cam member has a cam surface 64 engaged by a pin 66 on the end of a rod 68 pivoted intermediate its ends by a pin 70 on housing 38. The opposite end of the rod is pivotally coupled to a follower 72 shiftably mounted in a cylindrical member 74 extending downwardly from bottom wall 18 and surrounding a hole 76 in bottom wall 18. The purpose of follower 72 is to elevate player piece 24 onto the surface 22 of bottom wall 18 at a suitable time when maze 28 will not interfere with the ball as it is elevated by follower 72. By elevating player piece 24, the play of the game commences and the object of the game is to manipulate the game board surface 22 by tilting apparatus 10 back and forth, up and down and from side-to-side as maze 28 rotates under the influence of motor 40.

Surface 22 has a pair of side-by-side recesses 78 and 80 (FIG. 1) in base base 12 which extend from locations near the center of the base to outer peripheral side openings 82 and 84, respectively, which communicate with open top, member-receiving collector boxes 86 and 88. Box 86 represents the winning location and box 88 represents the losing location. The longer the recesses 78 and 80 are, the harder it is to win and the easier it is to lose. If player piece 24 falls into recess 80, it will pass through hole 84 and into losing box 88, it will signify a loss of the game. However, if member 24 falls into recess 78, it will pass through opening 82 and into box 86, indicating the winning of the game.

To commence a game, the circuit coupled with the motor is turned on and this causes maze 28 to commence rotating relative to and over surface 22. Player piece 24 will previously have been placed in hole 76 so that it will rest on follower 72 below the surface 22.

At precisely the right time, cam member 62 will cause rod 68 to pivot in a clockwise sense when viewing FIG. 2 to elevate player piece 24 until it is on surface 22. Then the player piece will be in play and the game will commence. The player piece will be oftentimes in the path of travel of maze 28 and is the object of the game to try to manually tilt or otherwise manipulate base 12 so that player piece 24 will be caused to pass through openings 32 and 36 until player piece 24 is aligned with and moves into recess 78, whereupon the player piece will pass through hole 82 and into the winning box 86 to end the game. Typically, maze 28 rotates only in one direction, namely in a clockwise sense when viewing FIG. 1. This tends to make it more difficult to keep player piece 24 out of recess 80 and to cause the player piece to drop into recess 78. By changing the speed of rotation of motor 40, this will increase or decrease the skill needed to win the game. The game can last from 1 to 15 minutes or more.

I claim:

1. Game apparatus comprising: a support having an upper surface over which a player piece is moveable; means above the surface for defining therewith a maze of passages for the player piece as it moves from a first location to a second location on said surface; means carried by said support for mounting said maze defining means for rotation relative to said surface; means adjacent to said mounting means for rotating said maze defining means relative to said surface, said base having a recess in said surface at said second location for receiving said player piece after the latter has been moved from said first location by the maze defining means and as the base is hand-held and manipulated.

2. Game apparatus as set forth in claim 1, wherein said maze defining means includes a plurality of walls having lower marginal edges adjacent to and moveable over said surface, certain of said walls having openings therethrough to permit the player piece to pass through the walls as it moves over said surface and as maze defining means is rotated.

3. Game apparatus as set forth in claim 1, wherein said rotating means includes an electric motor carried by the support below said surface.

4. Game apparatus as set forth in claim 3, wherein said means for mounting said maze defining means includes a shaft, and gear means coupling the motor with the shaft.

5. Game apparatus as set forth in claim 4, wherein said support has a hole through the upper surface thereof, and means responsive to the rotation of the maze defining means for elevating the player piece through the hole and onto the upper surface.

6. Game apparatus as set forth in claim 5, wherein said mounting means for the maze defining means comprises a shaft, said means for elevating the player piece including a cam member on the shaft, and a rod pivotally coupled to the support and coupled with the cam for elevating the player piece through the hole.

7. Game apparatus as set forth in claim 6, wherein said rod is pivotally coupled intermediate its ends on said support, one end of the rod being coupled to the cam member, and a follower on the other end of the rod for engaging and elevating the player piece.

8. Game apparatus as set forth in claim 1, wherein is included means coupled with said rotating means for varying the speed of rotation of said maze defining means.

9. Game apparatus as set forth in claim 1, wherein said base has a bottom wall, there being a pair of recesses in the bottom wall in side-by-side relationship to each other, each recess being coupled to a collector for receiving the player piece.

10. Game apparatus as set forth in claim 1, wherein said upper surface has a circular outer periphery, said maze defining means includes four mutually perpendicular arms having outer ends adjacent to the outer periphery of said upper surface.

* * * * *